US009216586B2

(12) United States Patent
Iwata

(10) Patent No.: US 9,216,586 B2
(45) Date of Patent: Dec. 22, 2015

(54) LIQUID EJECTING APPARATUS AND LIQUID TRANSFER METHOD

(75) Inventor: Yuji Iwata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/614,765

(22) Filed: Sep. 13, 2012

(65) Prior Publication Data

US 2013/0242005 A1 Sep. 19, 2013

(30) Foreign Application Priority Data

Sep. 14, 2011 (JP) ..... 2011-200958

(51) Int. Cl.
*B41J 2/175* (2006.01)
*B41J 29/38* (2006.01)

(52) U.S. Cl.
CPC ..... *B41J 2/17596* (2013.01); *B41J 2/175* (2013.01); *B41J 29/38* (2013.01)

(58) Field of Classification Search
USPC ..... 347/85, 86, 89
See application file for complete search history.

(56) References Cited

U.S. PATENT DOCUMENTS 5,561,448 A * 10/1996 Kaneko et al. ..... 347/29
5,943,078 A * 8/1999 Nishimoto et al. ..... 347/89
6,155,679 A * 12/2000 Sato ..... 347/92
6,224,201 B1 * 5/2001 Shigemura ..... 347/93
7,380,923 B2 * 6/2008 Matsuda et al. ..... 347/85
7,597,434 B2 * 10/2009 Nitta et al. ..... 347/89
7,726,782 B2 * 6/2010 Tsuchikawa ..... 347/60
7,850,290 B2 * 12/2010 Nitta et al. ..... 347/85
8,079,693 B2 * 12/2011 Hoshino ..... 347/92
8,128,212 B2 * 3/2012 Katada et al. ..... 347/89
8,287,064 B2 * 10/2012 Akatsuka et al. ..... 347/7
8,550,595 B2 * 10/2013 Kaneko ..... 347/40
2005/0052513 A1 * 3/2005 Inoue ..... 347/89
2005/0062818 A1 * 3/2005 Hashi et al. ..... 347/92
2005/0179757 A1 * 8/2005 Namekawa et al. ..... 347/86
2008/0239014 A1 * 10/2008 Hirashima et al. ..... 347/65
2009/0027461 A1 1/2009 Asada
2009/0102879 A1 * 4/2009 Katada et al. ..... 347/17
2010/0079517 A1 * 4/2010 Akatsuka et al. ..... 347/7
2010/0103208 A1 * 4/2010 Asami et al. ..... 347/7
2010/0110155 A1 * 5/2010 Delueg ..... 347/93
2010/0177148 A1 * 7/2010 Asami ..... 347/85

(Continued)

FOREIGN PATENT DOCUMENTS

EP 2018969 1/2009
JP 06-008465 1/1994

(Continued)

*Primary Examiner* — Matthew Luu
*Assistant Examiner* — Lily Kemathe
(74) *Attorney, Agent, or Firm* — Workman Nydegger

(57) ABSTRACT

A liquid ejecting apparatus includes a head unit that ejects a liquid onto a medium; a first liquid accommodation unit that accommodates the liquid; a second liquid accommodation unit that is different from the first liquid accommodation unit; a first flow channel that communicates with the first liquid accommodation unit and the head unit; a second flow channel that communicates with the first flow channel and the second liquid accommodation unit; and a liquid supply unit that delivers the liquid from the first liquid accommodation unit to the second liquid accommodation unit through the first flow channel and the second flow channel and that returns the liquid from the second liquid accommodation unit to the first liquid accommodation unit through the second flow channel and the first flow channel.

4 Claims, 8 Drawing Sheets

(56) References Cited

U.S. PATENT DOCUMENTS

| | | | | |
|---|---|---|---|---|
| 2010/0194798 | A1* | 8/2010 | Asami et al. | 347/7 |
| 2011/0128314 | A1 | 6/2011 | Akatsuka et al. | |
| 2011/0234714 | A1* | 9/2011 | Asami | 347/85 |

FOREIGN PATENT DOCUMENTS

| | | |
|---|---|---|
| JP | 2005-022124 | 1/2005 |
| JP | 2005-246908 | 9/2005 |
| JP | 2006-021197 | 1/2006 |
| JP | 2006-327097 | 12/2006 |
| JP | 2008-188963 | 8/2008 |
| JP | 2009-029022 | 2/2009 |
| JP | 2010-131757 | 6/2010 |
| JP | 2010-264678 | 11/2010 |
| JP | 2011-110833 | 6/2011 |
| JP | 2011-161648 | 8/2011 |

* cited by examiner

LIQUID EJECTING APPARATUS AND LIQUID TRANSFER METHOD

BACKGROUND

1. Technical Field

The present disclosure relates to a liquid ejecting apparatus and a liquid transfer method.

2. Related Art

As an example of a liquid ejecting apparatus, an ink jet printer which ejects a liquid such as an ink on various mediums such as papers or films and performs an image printing has been known. The ink jet printer includes an accommodation unit which accommodates the liquid and a head unit which ejects the liquid on the mediums. Then, if the liquid amount inside the head unit decreases due to the liquid ejection, the liquid is fed from the accommodation unit (for example, refer to JP-A-2005-246908).

If the ink jet printer is unused for a long period of time, there are cases where the liquid which is accommodated in the accommodation unit precipitates. Then, if the liquid precipitates, a density difference occurs between the upper side and the lower side in the accommodation unit. As a result, if printing an image using such a liquid after precipitation, the image quality thereof may be unstable.

SUMMARY

An advantage of some aspects of the present invention is that the density of the liquid which is ejected by the head unit may be uniform as much as possible so as to improve stability in a printed image quality.

According to an aspect of the invention, there is provided a liquid ejecting apparatus which includes a head unit that ejects a liquid onto a medium; a first liquid accommodation unit that accommodates the liquid; a second liquid accommodation unit that is different from the first liquid accommodation unit; a first flow channel that communicates with the first liquid accommodation unit and the head unit; a second flow channel that communicates with the first flow channel and the second liquid accommodation unit; and a liquid supply unit that delivers the liquid from the first liquid accommodation unit to the second liquid accommodation unit through the first flow channel and the second flow channel and that returns the liquid from the second liquid accommodation unit to the first liquid accommodation unit through the second flow channel and the first flow channel.

The other aspects of the invention will be made clear, based on the description and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
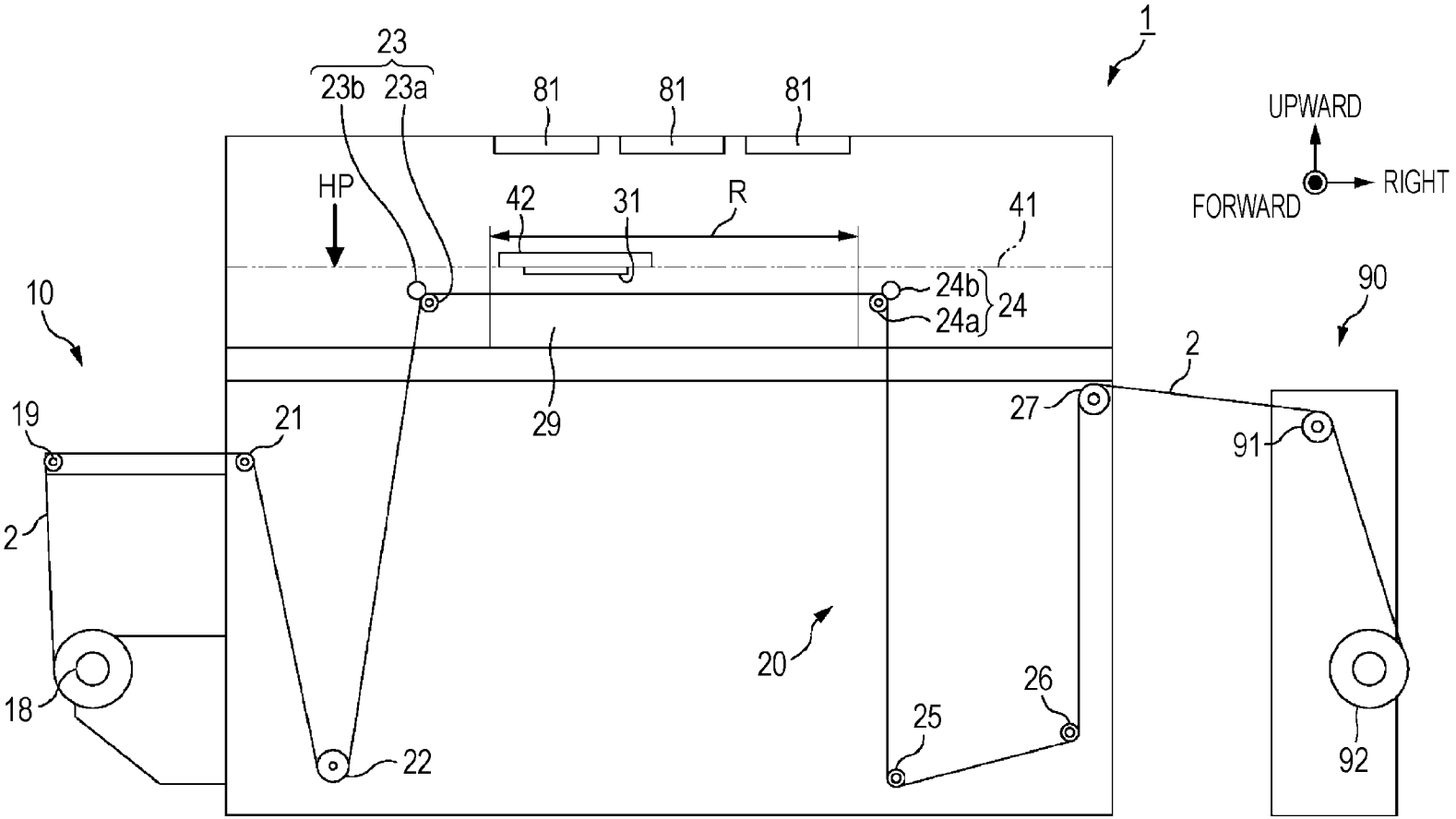
FIG. 1 is a perspective view illustrating a configuration of a printer.

The description and the accompanying drawings will disclose at least the following aspects.

That is, there is provided a liquid ejecting apparatus which includes a head unit that ejects a liquid onto a medium; a first liquid accommodation unit that accommodates the liquid; a second liquid accommodation unit that is different from the first liquid accommodation unit; a first flow channel that communicates with the first liquid accommodation unit and the head unit; a second flow channel that communicates with the first flow channel and the second liquid accommodation unit; and a liquid supply unit that delivers the liquid from the first liquid accommodation unit to the second liquid accommodation unit through the first flow channel and the second flow channel and that returns the liquid from the second liquid accommodation unit to the first liquid accommodation unit through the second flow channel and the first flow channel.

According to the liquid ejecting apparatus, density of the liquid which is ejected by the head unit is made to be as uniform as possible so as to improve the stability of printed image quality.

In addition, the liquid ejecting apparatus may further include an on-off valve that opens or closes an outflow of the liquid which is accommodated in the first liquid accommodation unit, being provided on the first flow channel. The first flow channel may be connected to the second flow channel at a position further to the head unit side than a position of the on-off valve.

According to the liquid ejecting apparatus, the density of the liquid may be further improved.

In addition, in the liquid ejecting apparatus, the first flow channel and the second flow channel may be plurally provided respectively. A plurality of the first flow channels and the second flow channels may include a first dedicated delivery flow channel and a second dedicated delivery flow channel where the liquid flows only during a delivery between the delivery and a return of the liquid; and a first dedicated return flow channel and a second dedicated return flow channel where the liquid flows only during the return. The liquid supply unit may deliver the liquid from the first liquid accommodation unit to the second liquid accommodation unit through the first dedicated delivery flow channel and the second dedicated delivery flow channel, and may also return the liquid from the second liquid accommodation unit to the first liquid accommodation unit through the first dedicated return flow channel and the second dedicated return flow channel.

According to the liquid ejecting apparatus, the density of the liquid may be further improved.

In addition, there is provided a liquid transfer method preparing for a liquid ejecting apparatus that includes a head unit which ejects a liquid onto a medium; a first liquid accommodation unit which accommodates the liquid; a second liquid accommodation unit which is different from the first liquid accommodation unit; a first flow channel which communicates with the first liquid accommodation unit and the head unit; a second flow channel which communicates with the first flow channel and the second liquid accommodation unit; and a liquid supply unit. The liquid supply unit that delivers the liquid from the first liquid accommodation unit to the second liquid accommodation unit through the first flow channel and the second flow channel and that returns the liquid from the second liquid accommodation unit to the first liquid accommodation unit through the second flow channel and the first flow channel.

According to the liquid transfer method, the density of the liquid which is ejected by the head unit may be as uniform as possible and consequently stability in printed image quality may be improved.

In the embodiments below, an ink jet printer 1 (hereinafter referred to as a "printer 1") will be exemplified as a liquid ejecting apparatus for description.

Embodiment

Configuration Example of Printer 1

Figure 2:
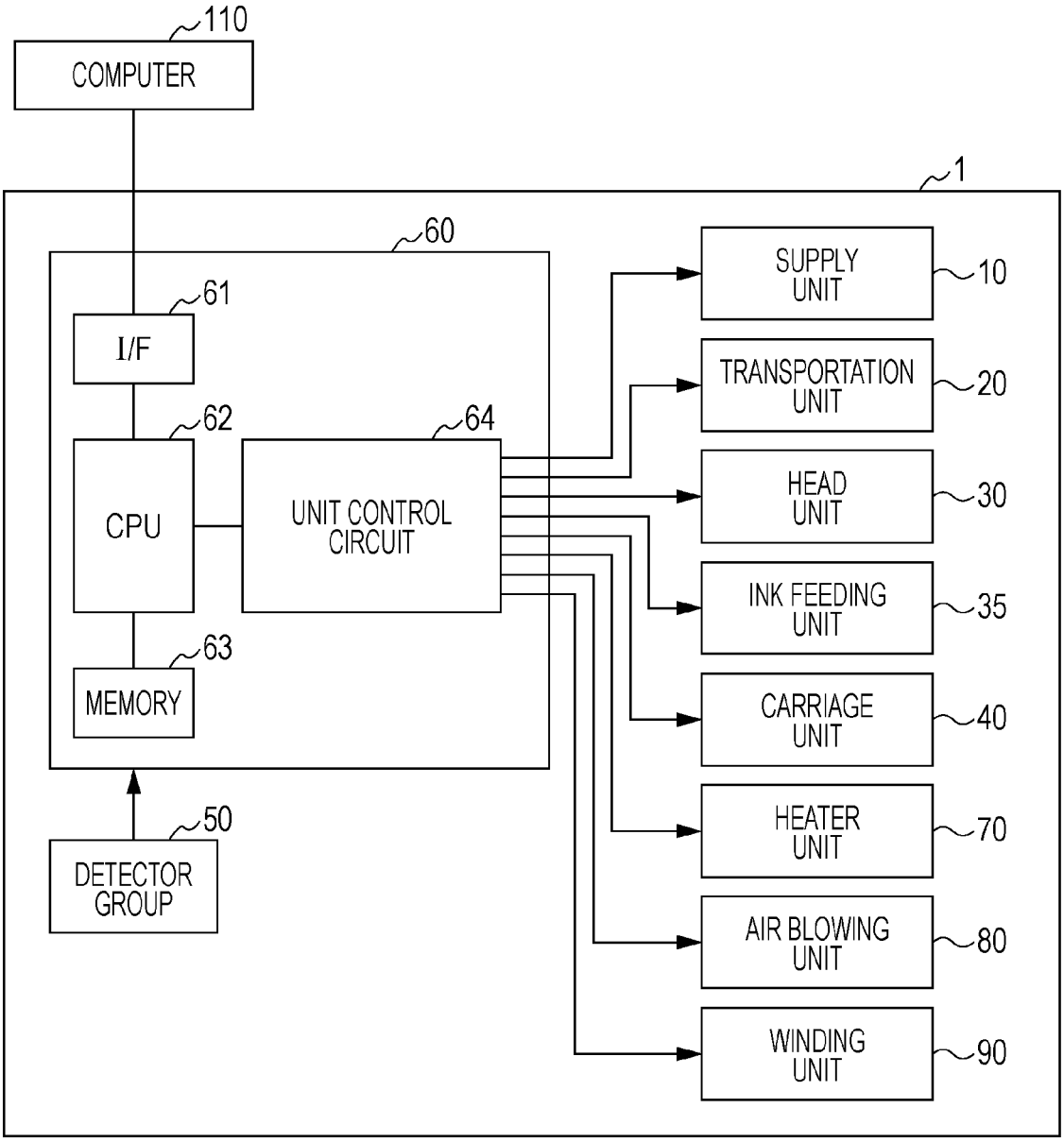
FIG. 2 is a block diagram illustrating a configuration of a printer.

A configuration example of a printer 1 will be described with reference to FIGS. 1 and 2. FIG. 1 is a schematic cross-sectional view of the printer 1. FIG. 2 is a block diagram of the printer 1.

In the following description, when referring to as an "upward-downward direction" and a "left-right direction", arrows in FIG. 1 indicates the direction as a reference. In addition, a "forward-backward direction" indicates the direction perpendicular to the paper surface in FIG. 1.

In addition, the present embodiment will be described using a sheet or a film (hereinafter referred to as a "roll sheet (continuous sheet)") which is wound up in roll state as a medium on which the printer 1 records an image.

Furthermore, the embodiment will be described using an ink (for example, pigmented ink) as an example of a liquid which is used in order for the printer 1 to record the image on the roll sheet. A pigmented ink is pigment articles forming a dyestuff that are dispersed inside a solvent. The pigmented ink has a tendency for the pigment particles to precipitate, if neglected for a long period of time.

As illustrated in FIGS. 1 and 2, the printer 1 according to the embodiment includes a transportation unit 20 as an example of a transportation part; a supply unit 10; a platen 29 as an example of a medium support part; a winding unit 90, along a transportation route on which the transportation unit 20 transports a roll sheet 2, and further includes a head unit 30 which performs printing in a printing region R on the transportation route; an ink feeding unit 35 which feeds the ink; a carriage unit 40 as an example of a head moving part; a heater unit 70 as an example of a heat supply part; an air blowing unit 80 which blows air to the roll sheet 2 on the platen 29; a controller 60 which controls the units or the like and administers an operation as the printer 1; and a detector group 50.

The supply unit 10 supplies the roll sheet 2 to the transportation unit 20. The supply unit 10 includes a scroll 18 which supports the roll sheet 2 to be rotatably wound and a transition roller 19 which winds the roll sheet 2 drawn from the scroll 18 and guides the roll sheet to the transportation unit 20.

The transportation unit 20 transports the roll sheet 2 supplied from the supply unit 10 along a predetermined transportation route. As illustrated in FIG. 1, the transportation unit 20 includes a transition roller 21 which positions on the right in the horizontal direction with respect to the transition roller 19; a transition roller 22 which positions diagonally downward to the right when seen from the transition roller 21; a first transportation roller 23 which positions diagonally upward to the right (upstream side of the transportation direction when seen from the platen 29) when seen from the transition roller 22; a second transportation roller 24 which positions on the right (downstream side of the transportation direction when seen from the platen 29) when seen from the first transportation roller 23; an inversion roller 25 which positions vertically downward when seen from the second transportation roller 24; a transition roller 26 which positions on the right when seen from the inversion roller 25; and a delivery roller 27 which positions upward when seen from the transition roller 26.

The transition roller 21 is a roller which winds from the left side and loosens downward the roll sheet 2 supplied from the transition roller 19.

The transition roller 22 is a roller which winds from the left side and transports diagonally upward to the right the roll sheet 2 supplied from the transition roller 21.

The first transportation roller 23 includes a first drive roller 23*a* which is driven by a motor (not illustrated) and a first driven roller 23*b* which is placed opposing the first drive roller 23*a* while pinching the roll sheet 2. The transportation roller 23 pulls up the roll sheet 2 which is loosened downward and transports the sheet to the printing region R which opposes the platen 29. The transportation roller 23 is set to temporarily stop the transportation while image printing is not performed with respect to the roll sheet 2 portion on the printing region R. Furthermore, the first driven roller 23*b* is rotated according to the rotation drive of the first drive roller 23*a* by the drive control of the controller 60. Thus, the transportation volume (length of the roll sheet portion) of the roll sheet 2 which is positioned on the platen 29 may be adjusted.

The transportation unit 20, as described above, includes a mechanism which transports by loosening downward the roll sheet 2 portion wound across the transition rollers 21 and 22 and the first transportation roller 23. The loosening of the roll sheet 2 is monitored by the controller 60 based on a detection signal from a loosening detection sensor (not illustrated). In detail, if the loosening detection sensor detects the roll sheet 2 portion which is loosened across the transition rollers 21 and 22 and the first transportation roller 23, the transportation unit 20 may transport the roll sheet 2 in a loosening state since an appropriately large tension is applied to the portion. In contrast, if the loosening detection sensor does not detect the roll sheet 2 portion which is loosened, the transportation unit 20 temporarily stops the transportation of the roll sheet 2 since an excessively large tension is applied to the portion and the tension may be adjusted to an appropriate magnitude.

The second transportation roller 24 includes a second drive roller 24*a* which is driven by a motor (not illustrated) and a second driven roller 24*b* which is placed opposing with respect to the second drive roller 24*a* while pinching the roll sheet 2. The transportation roller 24 transports the roll sheet 2 portion on which the image is recorded by the head unit 30, horizontally to the right along the supporting surface of the platen 29, and then transports vertically downward. As a result, the transportation direction of the roll sheet 2 is converted. Furthermore, the second driven roller 24*b* is rotated according to the rotation drive of the second drive roller 24*a* by the drive control of the controller 60. Thus, a predetermined tension applied with respect to the roll sheet 2 portion which positions on the platen 29 may be adjusted.

The inversion roller 25 winds the roll sheet 2 supplied from the second transportation roller 24 from the left upper side and transports diagonally upward to the right.

The transition roller 26 winds the roll sheet 2 supplied from the inversion roller 25 from the left lower side and transports upward.

The delivery roller 27 winds the roll sheet 2 supplied from the transition roller 26 from the left lower side and delivers the sheet to a winding unit 90.

As described above, the roll sheet 2 sequentially passes through each roller and thereby the transportation route is formed in order to transport the roll sheet 2. In addition, the roll sheet 2 is intermittently transported along the transportation route by the transportation unit 20 in region units corresponding to the printing region R.

The head unit 30 ejects ink onto the roll sheet 2 portion which is sent into the printing region R (on the platen 29) by the transportation unit 20. The head unit 30 includes a head 31.

The head 31, at the lower surface thereof, has rows of nozzles which line up in the row direction. The embodiment includes the row of nozzles respectively formed from a plurality of nozzles #1 to #N per color, white (W), cyan (C), magenta (M), yellow (Y), black (K) and the like. The respective nozzles #1 to #N in the rows of nozzles are arranged linearly in the crossing direction (row direction) which crosses the transportation direction of the roll sheet 2. The respective rows of the nozzles are placed in parallel apart from each other along the transportation direction.

The respective nozzles #1 to #N have a piezoelectric element (not illustrated) as a drive element in order to eject ink droplets. If a voltage of a predetermined time width is applied to between electrodes provided at both of ends of the piezoelectric element, the piezoelectric element expands in response to the application time of the voltage and deforms a side wall of the flow channel of the ink. As a result, the volume of the flow channel of the ink contracts in response to the expansion of the piezoelectric element and the ink which corresponds to the contraction becomes ink droplets which are ejected from the respective nozzles #1 to #N of each color.

When the ink amount inside the head unit 30 is decreased due to the ejection of the ink by the head 31, the ink feeding unit 35 feeds the ink to the head unit 30 and is plurally provided per ink colors. The ink feeding unit 35 is connected to the head unit 30 (head 31) via an ink supply tube. For that reason, the head 31 ejects the ink supplied from the ink feeding unit 35 with respect to the roll sheet 2 portion which is positioned on the platen 29 and thereby image printing may be performed. The ink feeding unit 35 will be described in detail later.

The carriage unit 40 moves the head unit 30 (head 31). The carriage unit 40 includes a guide rail 41 (illustrated by two-dot chain line in FIG. 1) which extends in the left-right direction, a carriage 42 which is supported so as to reciprocate in the left-right direction (moving direction) along the guide rail 41, and a motor (not illustrated). In the embodiment, the carriage 42 includes four sub-carriages and a plurality of heads 31 is provided for each of the sub-carriages.

The carriage 42 is configured so as to integrally move with the head 31 by the drive of the motor (not illustrated). The position (position in the left-right direction) of the carriage 42 (head 31 or each nozzle row) in the guide rail 41 may be obtained in such a manner that the controller 60 detects a rising edge and a falling edge in pulse signals output from an encoder which is provided at a motor (not illustrated) and counts the edges.

Then, when cleaning the head 31 after image printing, the carriage 42, being integrated with the head 31, moves in the transportation direction (upstream side) when seen from the platen 29 at the upstream side in the transportation direction along the guide rail 41 and stops at a home position HP where the cleaning is performed (refer to FIG. 1).

A cleaning unit (not illustrated) is provided at the home position HP. The cleaning unit includes a cap and a suction pump. If the carriage 42 positions at the home position HP, the cap (not illustrated) comes into contact with a lower surface (nozzle surface) of the head 31. If the suction pump (not illustrated) is operated in such an adhered state, the ink inside the head 31 is suctioned together with thickened ink or paper dust. Thus, a clogged nozzle is restored from the non-ejecting state and thereby the cleaning of the head is completed.

The platen 29 supports the roll sheet 2 portion which positions in the printing region R on the transportation route and heats the portion. As illustrated in FIG. 1, the platen 29 is provided corresponding to the printing region R on the transportation route and arranged at a region along the transportation route between the first transportation roller 23 and the second transportation roller 24. Thus, the platen 29 may heat the roll sheet 2 portion, receiving the supply of a heat generated by the heater unit 70.

The heater unit 70 is intended to heat the roll sheet 2 and includes a heater (not illustrated). The heater has nichrome wires and is configured so that the nichrome wires are arranged to have a constant distance from a supporting surface of the platen 29. For that reason, the heater, being electrically connected and the nichrome wires themselves generating heat, may transmit the heat to the roll sheet 2 portion which positions on the supporting surface of the platen 29. Since the heater is configured so that the nichrome wires are built-in all over the platen 29, the heat may be uniformly transmitted with respect to the roll sheet 2 portion on the platen 29. In the embodiment, the roll sheet 2 portion is uniformly heated such that the temperature of the roll sheet 2 portion on the platen 29 becomes 45° C. As a result, the ink which impacts the roll sheet 2 portion may be dried.

The air blowing unit 80 includes fans 81 as an example of a blower and a motor (not illustrated) which rotates the fans 81. The fans 81, by rotating, send air to the roll sheet 2 on the platen 29 and dry the ink which impacts the roll sheet 2. As illustrated in FIG. 1, a plurality of the fans 81 are provided in a cover (not illustrated) which is provided at the main body and capable of opening and closing. Then, each of the fans 81 positions upward from the platen 29 when the cover is closed and opposes the supporting surface (roll sheet 2 on the platen 29) of the platen 29.

The winding unit 90 winds the roll sheet 2 (roll sheet which finishes image printing) supplied by the transportation unit 20. The winding unit 90 includes a transition roller 91 which transports the roll sheet 2 supplied from the delivery roller 27 from the left upper side diagonally downward to the right and a winding drive shaft 92 which is rotatably supported and winds the roll sheet 2 supplied from the transition roller 91.

The controller 60 is a control unit for controlling the printer 1. As illustrated in FIG. 2, the controller 60 includes an interface unit 61, a CPU 62, a memory 63 and a unit control circuit 64. The interface unit 61 sends and receives data between a host computer 110 which is an external device and the printer 1. The CPU 62 is an arithmetic processing unit to control the entire printer 1. The memory 63 secures a region of the CPU 62 which stores programs, working space or the like. The CPU 62 controls each unit using the unit control circuit 64 according to the programs stored in the memory 63.

The detector group 50 monitors situations inside the printer 1 and, for example, includes a rotary-type encoder which is attached to the transportation roller and used in controlling the transportation of the medium or the like, a sheet detecting sensor which detects whether the transported medium is present or absent, and a linear-type encoder which detects the position of the carriage 42 (or head 31) in the moving direction (left-right direction).

Ink Feeding Unit 35

Figure 3:
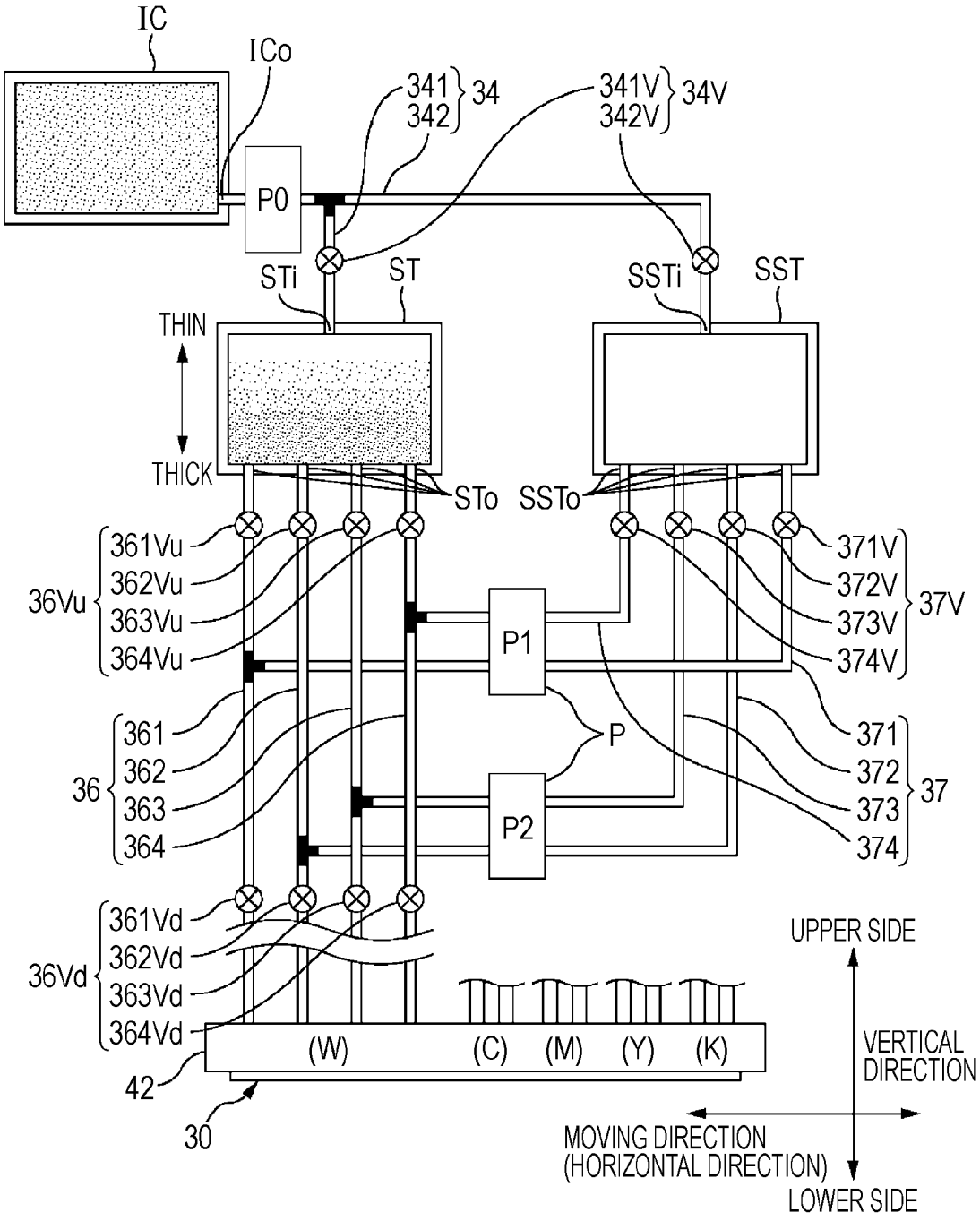
FIG. 3 is an explanatory view of a configuration example of an ink feeding unit.

Herein, a configuration example of an ink feeding unit 35 will be described with reference to FIG. 3. FIG. 3 is a view illustrating the configuration example of the ink feeding unit 35.

The ink feeding unit 35 supplies an ink to a head unit 30 and is plurally provided per each color. That is, each ink feeding unit 35 feeds the ink of different color to a corresponding head 31. In addition, herein, as each ink feeding unit 35 has the same configuration, the ink feeding unit 35 which supplies white ink (W) is exemplified for description. The white ink is water-based ink for which white titanium oxide (titanium oxide) is used as a pigment and is used for printing background color (white color) of a color image when printing on a transparent medium.

The ink feeding unit 35 includes an ink cartridge IC, a sub ink tank ST as an example of a first liquid accommodation unit, a spare ink tank SST as an example of a second liquid accommodation unit, a first ink supply tube 34 which supplies the ink flowed out of the ink cartridge IC to the sub ink tank ST or the spare ink tank SST, a second ink supply tube 36 as an example of a first flow channel which allows the sub ink tank ST to communicate with the head unit 30, a third ink supply tube 37 as an example of a second flow channel which allows the second ink supply tube 36 to communicate with the spare ink tank SST, and a supply pump P as an example of a liquid supply unit.

Ink Cartridge IC

The ink cartridge IC accommodates the ink for supplying to the head unit 30. As illustrated in FIG. 3, the ink cartridge IC includes an outlet port ICo where the first ink supply tube 34 is connected and which is provided at the lower side portion in the vertical direction. Then, the ink cartridge IC is configured to be detachably attached to the printer main body.

Sub Ink Tank ST

The sub ink tank ST temporarily accommodates the ink which is supplied to the head unit 30 from the ink cartridge IC. As illustrated in FIG. 3, the sub ink tank ST includes an inlet port STi where the first ink supply tube 34 is connected and which is provided at the upper side portion, and a plurality of openings STo where a plurality of the second ink supply tubes 36 is respectively connected and which is provided at the lower side portion.

The sub ink tank ST is fixed inside the printer. That is, the sub ink tank ST is configured not to be detachably attached to the printer main body unlike the ink cartridge IC.

Here, if the ink accommodated in the sub ink tank ST is neglected for a long period of time, the ink is apt to precipitate. As illustrated in FIG. 3, such precipitation may cause a density difference between the upper side and the lower side in the vertical direction inside the sub ink tank ST. Particularly, if the ink is a pigmented ink such as white ink, the density due to the precipitation markedly occurs. Then, if the ink after precipitation is used for printing an image, as time goes by, the image is gradually changed to have a different density compared to the initial image and accordingly the printed image quality may be degraded.

In contrast, in the embodiment, since the ink reciprocates between the sub ink tank ST and the spare ink tank SST, the precipitated ink inside the sub ink tank ST is stirred and thereby the uniformity of the density of the ink is improved. The details will be described later.

In addition, if the ink accommodated in the sub ink tank ST precipitates, the ink accommodated in the ink cartridge IC may well precipitate. However, since the ink cartridge IC is detachably attached to the printer main body, a user may detach the ink cartridge IC from the main body, shaking up and down, and thereby may eliminate the precipitation of the ink.

Spare Ink Tank SST

The spare ink tank SST temporarily accommodates the ink delivered from the sub ink tank ST in order to return the ink to sub ink tank ST.

As illustrated in FIG. 3, the spare ink tank SST includes an inlet port SSTi where the first ink supply tube 34 is connected and which is provided at the upper side portion in the vertical direction, and a plurality of openings SSTo where a plurality of the third ink supply tubes 37 are respectively connected and which is provided at the lower side portion in the vertical direction.

Here, as described above, since the ink accommodated in the sub ink tank ST precipitates after the passage of an extended period of time, density difference occurs between the upper side and the lower side in the vertical direction inside the sub ink tank ST as illustrated in FIG. 3. In such a case, the ink accommodated in the sub ink tank ST is sequentially delivered to the spare ink tank SST by the supply pump P. The spare ink tank SST may temporarily accommodate the ink delivered from the sub ink tank ST by successively admitting the ink from the opening SSTo. Then, if the movement of the ink accommodated in the sub ink tank ST is all completed, the ink accommodated in the spare ink tank SST is returned to the sub ink tank ST again by the supply pump P before precipitation.

In this manner, the ink is stirred by reciprocating between the sub ink tank ST and the spare ink tank SST and thereby uniformity of the density of the ink may be improved. In addition, an operation example for agitating the ink will be described in detail later.

First Ink Supply Tube 34

The first ink supply tube 34 is a flow channel formed so as to supply the ink from the ink cartridge IC to the sub ink tank ST or the spare ink tank SST and includes a supply pump P0 and a valve 34V on the flow channel.

In the embodiment, as illustrated in FIG. 3, there are provided a first ink supply tube 341 which connects the outlet port ICo of the ink cartridge IC to the inlet port STi of the sub ink tank ST, and a first ink supply tube 342 which connects the outlet port ICo of the ink cartridge IC to the inlet port SSTi of the spare ink tank SST.

The valve 34V is an on-off valve in order to open or close the flow channel of the first ink supply tube 34 and performs an opening-closing operation in response to the control signal from the controller 60 when replacing the ink cartridge IC or when supplying the ink to the sub ink tank ST or the spare ink tank SST.

In the embodiment, a valve 341V is provided on the flow channel of the first ink supply tube 341 and a valve 342V is provided on the flow channel of the first ink supply tube 342.

In addition, the valves 341V and 342V are check valves and thereby the ink may not flow back from the sub ink tank ST or the spare ink tank SST to the ink cartridge IC.

The supply pump P0 supplies compressed air in response to the control signal from the controller 60, suctioning the ink inside the ink cartridge IC, and thereby sends the ink into the sub ink tank ST or the spare ink tank SST.

Second Ink Supply Tube 36

AS illustrated in FIG. 3, the second ink supply tube 36 is a flow channel formed so as to supply the ink from the sub ink tank ST to the head unit 30. Then, a valve 36Vu of the upstream side and a valve 36Vd of the downstream side are provided on the flow channel.

In the embodiment, as illustrated in FIG. 3, four second ink supply tubes 361 to 364 are provided as the flow channel for supplying white ink and each tube allows the sub ink tank ST to respectively communicate with the head unit 30. To provide the four second ink supply tubes 361 to 364 in this manner is because a carriage 42 according to the embodiment includes four sub-carriages, each sub-carriage having a plurality of the heads 31 and allowing each of the sub-carriages to correspond to the ink supply tube, and supplies white ink to the respective heads 31.

The valves 36Vu and 36Vd are on-off valves in order to open or close the flow channel of the second ink supply tube 36 and performs an opening-closing operation in response to the control signal from the controller 60 when allowing the ink to move between the sub ink tank ST and the spare ink tank SST.

In the embodiment, as illustrated in FIG. 3, there are provided valves 361Vu to 364Vu of the upstream side and valves 361Vd to 364Vd of the downstream side respectively corresponding to a plurality of the second ink supply tubes 361 to 364.

Third Ink Supply Tube 37

As illustrated in FIG. 3, a third ink supply tube 37 is a flow channel formed so as to allow the spare ink tank SST to communicate with the first ink supply tube 36. Then, a valve 37V and the supply pump P as an example of the liquid supply unit are provided on the flow channel.

In the embodiment, as illustrated in FIG. 3, four third ink supply tubes 371 to 374 are provided as the flow channel for supplying white ink and each tube is connected to each of the second ink supply tubes 361 to 364. Accordingly, the sub ink tank ST and the spare ink tank SST may be communicated with each other.

The valve 37V is the on-off valve in order to open or close the flow channel of the third ink supply tube 37 and performs an opening-closing operation in response to the control signal from the controller 60 when allowing the ink to move between the sub ink tank ST and the spare ink tank SST.

In the embodiment, as illustrated in FIG. 3, there are provided valves 371V to 374V respectively corresponding to a plurality of the third ink supply tubes 371 to 374.

Supply Pump P

The supply pump P supplies compressed air and thereby allows the ink to flow between the sub ink tank ST and the spare ink tank SST. That is, the supply pump P supplies the compressed air in response to the control signal from the controller 60, suctioning the ink inside the sub ink tank ST, delivering the ink into the spare ink tank SST, and suctioning the ink inside the spare ink tank SST, and thereby may return the ink to the sub ink tank ST.

In the embodiment, as illustrated in FIG. 3, there are provided a supply pump P1 which suctions the ink inside the sub ink tank ST and delivers the ink into the spare ink tank SST, and a supply pump P2 which suctions the ink inside the spare ink tank SST and returns the ink to the sub ink tank ST. The supply pump P1 is provided on the flow channel formed by connecting the second ink supply tube 361 to the third ink supply tube 371 and on the flow channel formed by connecting the second ink supply tube 364 to the third ink supply tube 374. The supply pump P2 is provided on the flow channel formed by connecting the second ink supply tube 362 to the third ink supply tube 372 and on the flow channel formed by connecting the second ink supply tube 363 to the third ink supply tube 373. That is, the flow channel formed by connecting the second ink supply tube 361 to the third ink supply tube 371 and the flow channel formed by connecting the second ink supply tube 364 to the third ink supply tube 374 may form a dedicated delivery flow channel for delivering the ink from the sub ink tank ST to the spare ink tank SST. In contrast, the flow channel formed by connecting the second ink supply tube 362 to the third ink supply tube 372 and the flow channel formed by connecting the second ink supply tube 363 to the third ink supply tube 373 may form a dedicated returning flow channel for returning the ink from the spare ink tank SST to the sub ink tank ST.

Operation Example of Printer 1

Next, an operation example related to ink feeding of a printer 1 will be described. Various operations of the printer 1 are realized mainly by a controller 60. In particular, in the embodiment, a CPU 62 processes a program stored in a memory 63. Then, the program is configured by a code for performing various operations which is to be described below.

Ink Supply from Ink Cartridge IC to Sub Ink Tank ST

First, an operation example for supplying an ink from an ink cartridge IC to a sub ink tank ST will be described.

A sensor (not illustrated) detects whether residual quantity of the ink is small inside the sub ink tank ST. A controller 60 performs a control for feeding the ink inside the ink cartridge IC to the sub ink tank ST, based on a detection signal from the sensor.

First, the controller 60 controls opening and closing operations of each valve, closing valves 342V, 36Vu and 37V, and opens a valve 341V. As a result, flow channels of a first ink supply tube 342, a plurality of second ink supply tubes 36 and a plurality of third ink supply tubes 37 are closed, and the flow channel of a first ink supply tube 341 is open.

Next, the controller 60 drives a supply pump P0 to suction the ink inside the ink cartridge IC and to deliver the ink to the sub ink tank ST. As a result, the ink flowed out of the ink cartridge IC flows through the first ink supply tube 341 to be accommodated in the sub ink tank ST.

If the ink accommodated in the sub ink tank ST remains unused for a long period of time, precipitation of the ink occurs.

In the embodiment, with respect to the precipitation, in order to improve the uniformity of the density of the ink accommodated in the sub ink tank ST, the ink is made to reciprocate between the sub ink tank ST and a spare ink tank SST and thereby the precipitated ink is stirred. Herein, the agitating operation will be described.

Agitating Operation

Figure 4:
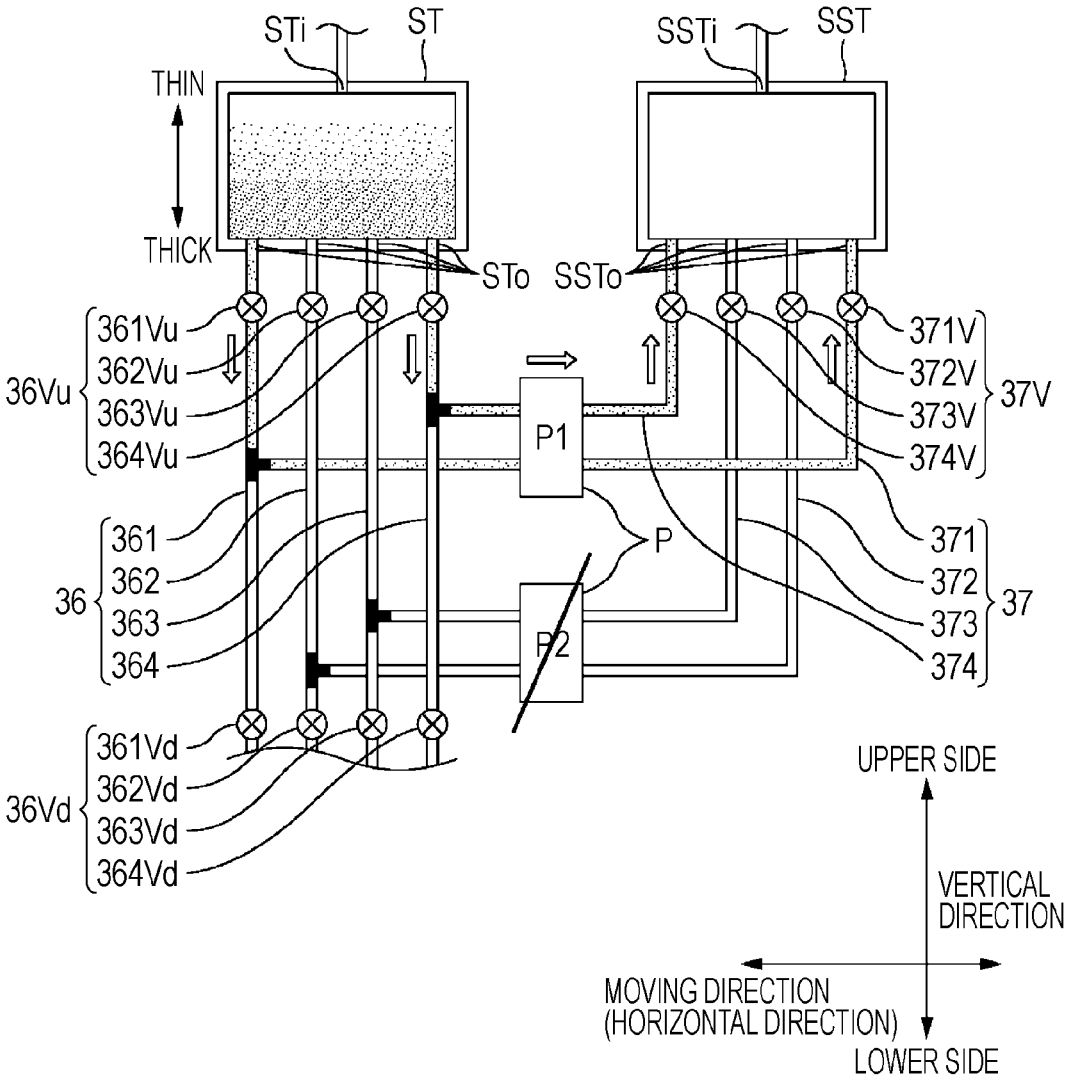
FIG. 4 is an explanatory view of an operation example for agitating inks, illustrating a state where a sub-ink tank ST starts to deliver inks to a spare ink tank SST.
Figure 5:
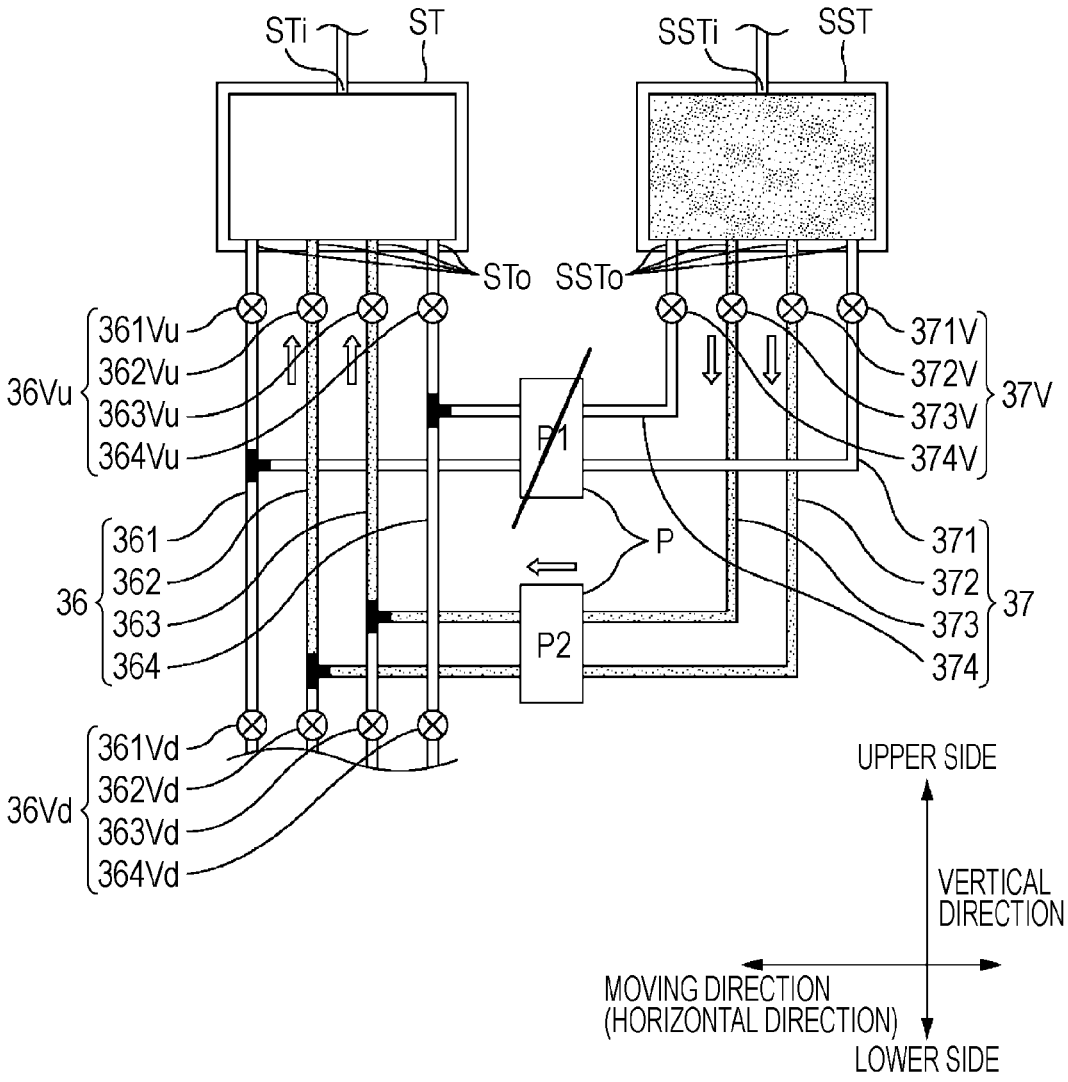
FIG. 5 is an explanatory view of an operation example for agitating inks, illustrating a state where a sub-ink tank ST starts to deliver inks to a spare ink tank SST.
Figure 6:
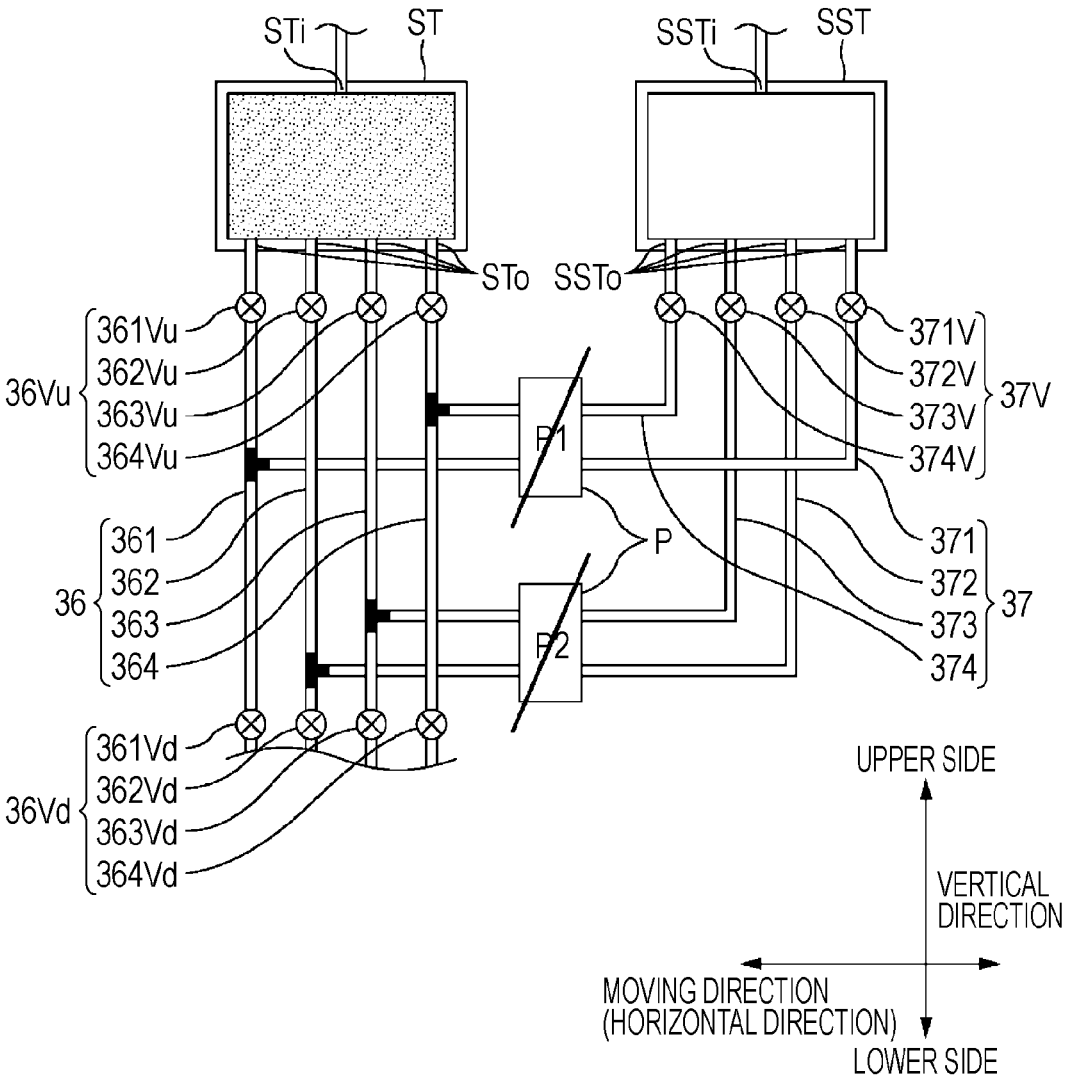
FIG. 6 is an explanatory view of an operation example for agitating inks, illustrating a state of a sub-ink tank ST after being stirred.

Next, an operation example for agitating the precipitated ink inside the sub ink tank ST will be described with reference to FIGS. 3 to 6. FIG. 4 illustrates a state where a delivery of the ink is started from the sub ink tank ST to the spare ink tank SST. FIG. 5 illustrates a state where a return of the ink is started from the spare ink tank SST to the sub ink tank ST. FIG. 6 illustrates a state of the sub ink tank ST after being stirred.

As illustrated in FIG. 3, the controller 60 controls opening and closing operations of each valve, closing valves 341V, 342V, 361Vd to 364Vd, and opens valves 361Vu to 364 Vu and 371V to 374V. As a result, flow channels on the downstream side from the sub ink tank ST to the head unit 30 among the first ink supply tubes 341 and 342 and the second ink supply tubes 361 to 364 are closed. Flow channels on the upstream side from the sub ink tank ST to the spare ink tank SST among the second ink supply tubes 361 to 364 and flow channels of the third ink supply tubes 371 to 374 are open.

Next, as illustrated in FIG. 4, the controller 60 drives only the supply pump P1 to sequentially deliver the ink inside the sub ink tank ST toward the spare ink tank SST. As a result, the ink flowed out of openings STo of both left and right ends flows to the respective third ink supply tubes 371 and 374 via the second ink supply tubes 361 and 364, and is successively accommodated in the spare ink tank SST.

Then, a sensor (not illustrated) detects whether all of the ink inside the sub ink tank ST removed. At this time, as illustrated in FIG. 5, the ink delivered from the sub ink tank ST, being slightly mixed, is accommodated in the spare ink tank SST.

The controller 60 stops the drive of the supply pump P1 and starts the drive of the supply pump P2 in order to immediately return the ink inside the spare ink tank SST to sub ink tank ST, based on the detection signal from the sensor (not illustrated).

As illustrated in FIG. 5, the controller 60 continuously drives only the supply pump P2 to suction the ink inside the spare ink tank SST and sequentially return the ink toward the sub ink tank ST. As a result, the ink flowed out of a central opening SSTo flows to the respective second ink supply tubes 362 and 363 via the respective third ink supply tubes 372 and 373 and is successively accommodated in the sub ink tank ST. Then, the controller 60 drives the supply pump P2 until the ink inside the spare ink tank SST is removed (until detected by a sensor, not illustrated detects)

In this manner, since the controller 60, driving the supply pumps P1 and P2, controls to adjust pressure difference between inside the sub ink tank St and inside the spare ink tank SST, the ink reciprocates between the sub ink tank ST and the spare ink tank SST. Then, such a reciprocating movement stirs the precipitated ink inside the sub ink tank ST and thereby the uniformity of the density of the ink may be improved.

As illustrated in FIG. 6, the controller 60 controls opening and closing operations of each valve, closing valves 371V to 374V, and opens valves 361Vu to 364 Vu and 361Vd to 364Vd. As a result, the ink after being agitated (ink after the density is uniformized) flows out of the respective openings STo of the sub ink tank ST, flowing to the respective second ink supply tubes 36, and is supplied to the head unit 30 (head 31).

In addition, in the embodiment, the operation example where the reciprocating movement between the sub ink tank ST and the spare ink tank SST is performed only once is described as above. However, the reciprocating movement may be performed twice or more. The more reciprocating movement is repeated, the more the uniformity of the density of the ink is improved.

Effectiveness of Printer 1 According to Embodiment

As described above, the printer 1 according to the embodiment includes the head unit 30 which ejects the ink to the roll sheet 2; the sub ink tank ST which accommodates the ink; the spare ink tank SST which is different from the sub ink tank ST; the second ink supply tube 36 which allows the sub ink tank ST to communicate with the head unit 30; the third ink supply tube 37 which allows the second ink supply tube 36 to communicate with the spare ink tank SST; and the supply pump P which delivers the ink from the sub ink tank ST to the spare ink tank SST via the second ink supply tube 36 and the third ink supply tube 37, and returns the ink from the spare ink tank SST to the sub ink tank ST via the third ink supply tube 37 and the second ink supply tube 36. Accordingly, since the ink is allowed to reciprocate between the sub ink tank ST and the spare ink tank SST, the precipitated ink is mixed to improve the uniformity of the density of the ink. For that reason, even if precipitation of the ink occurs due to long term neglecting of the ink, an image which has uniform density may be printed and thereby printed image quality may be stably improved. In addition, if precipitation occurs, since the ink cartridge IC is detachably attached to the printer main body, a user may detach the ink cartridge IC from the main body and shake the ink cartridge IC up and down to solve the precipitation of the ink. On the other hand, since the sub ink tank ST is not detachable from the main body, the relevant maintenance work may not be performed. Accordingly, the invention according to the present embodiment is effective in a case where the precipitation of the ink occurs in the sub ink tank ST.

Hereinafter, a comparative example will firstly be described and then the effectiveness of the printer 1 according to the embodiment will be described.

Figure 7:
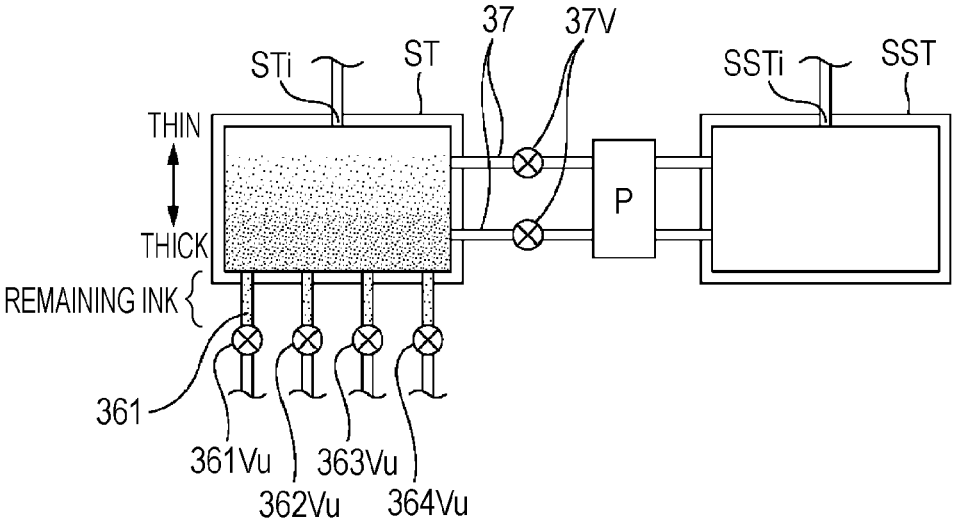
FIG. 7 is an explanatory view of a first comparative example.

FIG. 7 is an explanatory view of a first comparative example. An ink feeding unit 35 according to the comparative example, unlike the embodiment, allows a sub ink tank ST to communicate with a spare ink tank SST using only a third ink supply tube 37 and a valve 37V and a supply pump P are provided on a flow channel of the third ink supply tube 37. Then, a controller 60 closes valves 361Vu to 364Vu, opens a valve 37V and drives the supply pump P to suction an ink inside a sub ink tank ST, to deliver the ink to a spare ink tank SST, to suction the ink inside the spare ink tank SST and to sequentially return the ink toward the sub ink tank ST. As a result, since the ink reciprocates between the sub ink tank ST and the spare ink tank SST, the precipitated ink is mixed and thereby the uniformity of the density of the ink may be improved.

Here, as illustrated in FIG. 7, in the comparative example, for example, the ink which is present between the sub ink tank ST and the valve 361Vu among the inks which are present inside the second ink supply tube 361 does not reciprocate between the sub ink tank ST and the spare ink tank SST and has a tendency to remain at the position.

In contrast, the printer 1 according to the embodiment includes a valve 36Vu which is provided on the second ink supply tube 36 and opens or closes the flowing out of the ink accommodated in the sub ink tank ST, and the second ink supply tube 36 is set to be connected to the third ink supply tube 37 at a position of a head unit 30 side than the position of the valve 36Vu. For that reason, as illustrated in FIG. 4, the embodiment allows that the ink which is present between the sub ink tank ST and the valve 361Vu among the inks which are present inside the second ink supply tube 361 reaches the spare ink tank SST via the third ink supply tube 371. As a result, the remaining ink may reciprocate between the sub ink tank ST and the spare ink tank SST due to a agitating operation thereafter. Thus, all the precipitated ink may be mixed to improve uniformity of the density of the ink.

Figure 8:
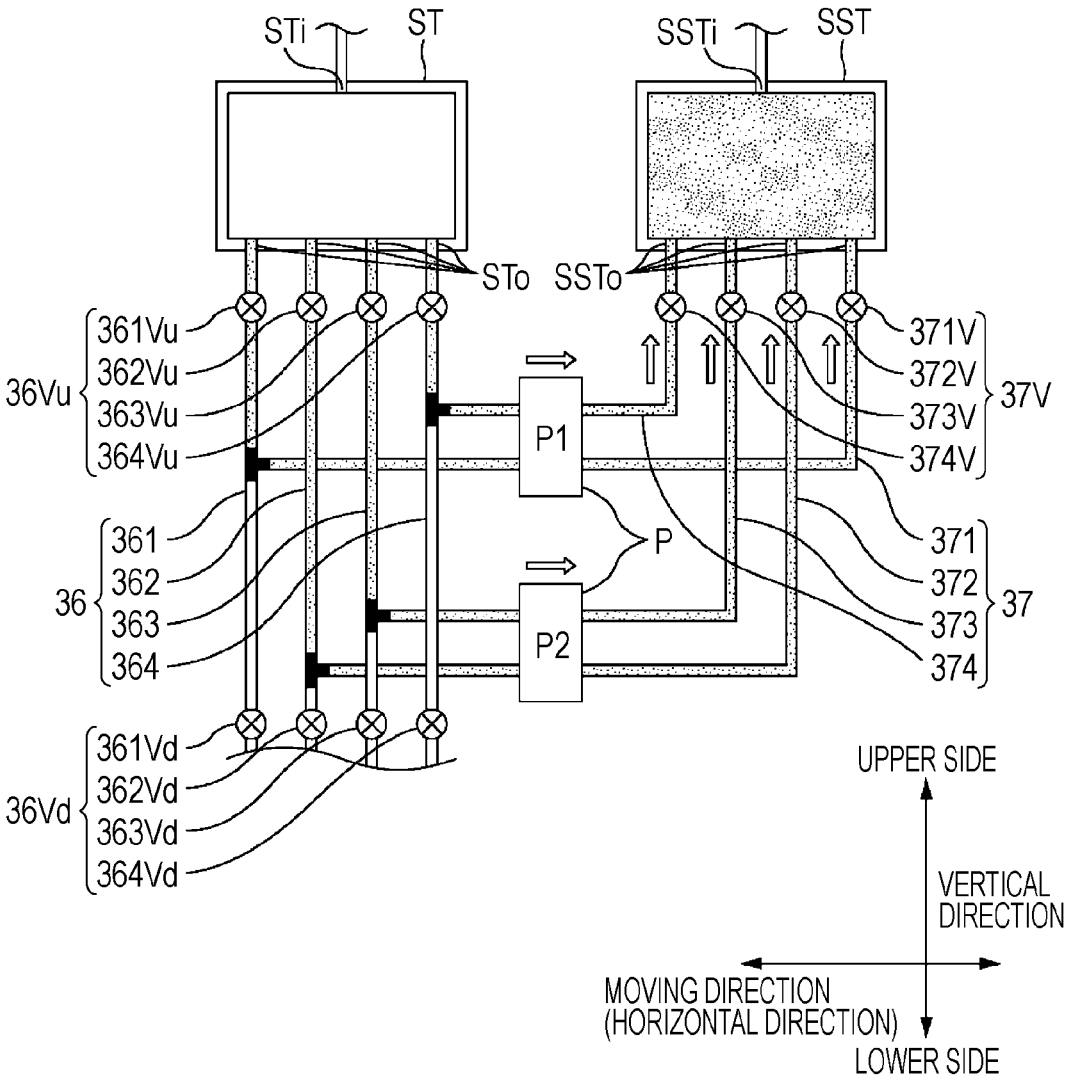
FIG. 8 is an explanatory view of a second comparative example.

FIG. 8 is an explanatory view of a second comparative example. An ink feeding unit 35 according to the comparative example, unlike the embodiment, simultaneously drives supply pumps P1 and P2 when ink is allowed to reciprocate between a sub ink tank ST and a spare ink tank SST. Thus, the pumps delivers the ink using all of four second ink supply tubes 36 and third ink supply tubes 37, and returns the ink using all of the four third ink supply tubes 37 and the second ink supply tubes 36. As a result, the precipitated ink may be mixed to improve the uniformity of the density of the ink.

Here, as illustrated in FIG. 8, in the comparative example, for example, if the supply pumps P1 and P2 are operated in order to deliver the ink inside the sub ink tank ST to the spare ink tank SST, the ink flows through second ink supply tubes 361 to 364, flows through third ink supply tubes 371 to 374 and reaches the spare ink tank SST. However, some ink may not reach the spare ink tank SST and may remain inside the second ink supply tubes 361 to 364 and the third ink supply tubes 371 to 374. As a result, if the supply pumps P1 and P2 are operated to return the ink inside the spare ink tank SST to the sub ink tank ST, the remaining ink may not be mixed inside the spare ink tank SST and may return to the sub ink tank ST without change.

In contrast, in the printer 1 according to the embodiment, a plurality of second ink supply tubes 36 and third ink supply tubes 37 are respectively provided. Among a plurality of the second ink supply tubes 36 and the third ink supply tubes 37, between delivering and returning the liquid, second ink supply tubes 361 and 364 and third ink supply tubes 371 and 374 are provided through which a liquid flows only when delivering the liquid, and second ink supply tubes 362 and 363 and third ink supply tubes 372 and 373 are provided through which the liquid flows only when returning the liquid. The supply pump P delivers the liquid from the sub ink tank ST to the spare ink tank SST via the second ink supply tubes 361 and 364 and the third ink supply tubes 371 and 374, and returns the liquid from the spare ink tank SST to the sub ink tank ST via the second ink supply tubes 362 and 363 and the third ink supply tubes 372 and 373. In this manner, the embodiment may use four second ink supply tubes 36 and four third ink supply tubes 37 by dividing the tubes into two tubes each. Accordingly, a dedicated delivery flow channel for delivering the ink from the sub ink tank ST to the spare ink tank SST and a dedicated returning flow channel for returning the ink from the spare ink tank SST to the sub ink tank ST may be formed. For that reason, for example, in a case where the supply pumps P1 and P2 are operated in order to deliver the ink inside the sub ink tank ST to the spare ink tank SST, even if the ink remains inside the second ink supply tubes 361 to 364 and the third ink supply tubes 371 to 374, the remaining ink may reach the spare ink tank SST due to the agitating operation thereafter. As a result, the remaining ink may reciprocate between the sub ink tank ST and the spare ink tank SST. Thus, all the precipitated ink may be mixed and the uniformity of the density of the ink may be more improved.

Another Embodiment

The embodiment mainly describes a liquid ejecting apparatus, but includes a disclosure of a liquid transfer method or the like. In addition, the embodiment is to facilitate understanding of the invention and is not construed as limiting the invention. The invention may be modified and improved without departing from the spirit. It is obvious that the invention includes equivalents thereof. In particular, even the embodiment described below may be included in the invention.

Liquid Ejecting Apparatus

In the above-described embodiment, an ink jet type printer is exemplified as a liquid ejecting apparatus, but not limited thereto. For example, a liquid ejecting apparatus which ejects another liquid besides ink may also be exemplified. Various liquid ejecting apparatuses which include a liquid ejecting head to eject a micro-droplet may be adaptable. Furthermore, the droplet means a state of the liquid which is ejected from the liquid ejecting apparatus and includes being granular, tear-like and pulled into a thread-like tail. In addition, the so-called liquid may be a material which the liquid ejecting apparatus may eject. For example, a substance may be acceptable if the substance is in a state of liquid phase. Liquid-like bodies with high or low viscosity, sol, gel water, other inorganic solvents, organic solvents, solutions, liquid resins and liquid metals (metallic melt) may be included. In addition, without being limited to liquid as a state of substance, anything in which particles of functional material formed from solids such as pigments or metal particles are dissolved, dispersed or mixed in a solvent may be included. Further, an ink as described in the embodiment, a liquid crystal or the like may be mentioned as a typical example of the liquid. Herein, the ink includes various liquid compositions such as a general water-based ink, oil-based ink, gel ink, hot melt ink or the like. As a specific example of the liquid ejecting apparatus, for example, there may be a liquid ejecting apparatus that ejects liquid containing, in the form of dispersed or dissolved material, electrode materials or coloring materials or the like used in manufacturing a liquid crystal display, an EL (electroluminescence) display, a plane emission display, a color filter or the like; a liquid ejecting apparatus that ejects liquid which becomes a sample by being used as a precision pipette; printing equipment; a micro-dispenser or the like. In addition, a liquid ejecting apparatus that ejects a pinpoint of lubricant to precision machinery such as timepieces or cameras; a liquid ejecting apparatus that ejects transparent resin liquid of ultraviolet curable resin onto a substrate in order to form a fine semi-spherical lens (optical lens) which is used in optical communication element or the like; and a liquid ejecting apparatus that ejects an etching liquid such as acid, alkali or the like in order to etch the substrate or the like may be employed. The invention may be adaptable to any one of the above apparatuses.

Agitating Operation

In the embodiment, a case where a agitating operation is started by an ink feeding unit 35 when a head unit 30 stops a printing operation is exemplified for description, but not limited thereto.

For example, the agitating operation may be started before starting the printing operation after power-up.

In addition, by providing a timer to count periods when power-off state continues, the agitating operation may be started every time when a predetermined time elapses.

In detail, a computer 60 obtains timekeeping information (power-off period) from the timer, reads out predetermined period information (for example, two months) from a memory 63 and compares the information. Then, the computer 60 determines whether the power-off period is equivalent to or more than a predetermined period (two months) and if equivalent to or more than the predetermined period, performs a process for the agitating operation.

In this manner, even if the precipitation of an ink occurs inside a sub ink tank ST, uniformity of the density of the ink may be obtained at an appropriate time.

This application claims the benefit of Japanese Patent Application No. 2011-200958 filed on Sep. 14, 2011, which is hereby incorporated by reference herein in its entirety.

What is claimed is:

1. A liquid ejecting apparatus comprising:

a head unit that ejects a liquid onto a medium;

a first liquid accommodation unit that accommodates the liquid;

a second liquid accommodation unit that is different from the first liquid accommodation unit;

a first flow channel that communicates with the first liquid accommodation unit and the head unit;

a second flow channel that communicates with the first flow channel and the second liquid accommodation unit, the second flow channel being connected to the first flow channel at a location that is downstream of the first and second liquid accommodation units and upstream of the head unit in a direction that the liquid travels from the liquid accommodation units to the head unit; and a liquid supply unit that delivers substantially all the liquid from the first liquid accommodation unit to the second liquid accommodation unit through the first flow channel and the second flow channel, circumventing the head unit, and that returns substantially all the liquid from the second liquid accommodation unit to the first liquid accommodation unit through the second flow channel and the first flow channel.

2. The liquid ejecting apparatus according to claim 1 further comprising:

an on-off valve that opens or closes an outflow of the liquid which is accommodated in the first liquid accommodation unit, being provided on the first flow channel, wherein the first flow channel is connected to the second flow channel at a position further to the head unit side than a position of the on-off valve.

3. The liquid ejecting apparatus according to claim 1, wherein the first flow channel and the second flow channel are plurally provided respectively, wherein a plurality of the first flow channels and the second flow channels includes a first dedicated delivery flow channel and a second dedicated delivery flow channel where the liquid flows only during a delivery, and a first dedicated return flow channel and a second dedicated return flow channel where the liquid flows only during a return between the delivery and the return of the liquid, and wherein the liquid supply unit delivers the liquid from the first liquid accommodation unit to the second liquid accommodation unit through the first dedicated delivery flow channel and the second dedicated delivery flow channel, and returns the liquid from the second liquid accommodation unit to the first liquid accommodation unit through the first dedicated return flow channel and the second dedicated return flow channel.

4. A liquid transfer method comprising:

preparing a liquid ejecting apparatus which includes a head unit that ejects a liquid onto a medium, a first liquid accommodation unit that accommodates the liquid, a second liquid accommodation unit that is different from the first liquid accommodation unit, a first flow channel that communicates with the first liquid accommodation unit and the head unit, a second flow channel that communicates with the first flow channel and the second liquid accommodation unit, the second flow channel being connected to the first flow channel at a location that is downstream of the first and second liquid accommodation units and upstream of the head unit in a direction that the liquid travels from the liquid accommodation units to the head unit, and a liquid supply unit; and causing the liquid supply unit to deliver substantially all the liquid from the first liquid accommodation unit to the second liquid accommodation unit through the first flow channel and the second flow channel, circumventing the head unit, and to return substantially all the liquid from the second liquid accommodation unit to the first liquid accommodation unit through the second flow channel and the first flow channel.

* * * * *